US009053922B2

(12) United States Patent
Poortmans et al.

(10) Patent No.: US 9,053,922 B2
(45) Date of Patent: Jun. 9, 2015

(54) METHOD OF MANUFACTURING AN ELECTRODE FOR A GAS DISCHARGE LAMP

(75) Inventors: Stijn Poortmans, Vaalbeek (BE); Benny Van Daele, Olen (BE); Kurt Marcel Frieda Van Bylen, Dessel (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 70 days.

(21) Appl. No.: 13/884,041

(22) PCT Filed: Oct. 18, 2011

(86) PCT No.: PCT/IB2011/054616

§ 371 (c)(1), (2), (4) Date: May 8, 2013

(87) PCT Pub. No.: WO2012/063151

PCT Pub. Date: May 18, 2012

(65) Prior Publication Data

US 2013/0257269 A1 Oct. 3, 2013

(30) Foreign Application Priority Data

Nov. 10, 2010 (EP) ..... 10190586

(51) Int. Cl.

*H01J 61/073* (2006.01)
*H01J 9/02* (2006.01)
*H01J 61/86* (2006.01)

(52) U.S. Cl.

CPC ..... *H01J 61/0732* (2013.01); *H01J 9/02* (2013.01); *H01J 61/86* (2013.01)

(58) Field of Classification Search

USPC ..... 313/620, 621, 631, 632, 357; 445/46, 445/49

See application file for complete search history.

(56) References Cited

U.S. PATENT DOCUMENTS 5,357,167 A * 10/1994 Mathews et al. ..... 313/632
5,387,839 A * 2/1995 Giordano et al. ..... 313/623

(Continued)

FOREIGN PATENT DOCUMENTS

EP 2278610 A1 1/2011
JP 2004164996 A 6/2004

(Continued)

*Primary Examiner* — Thomas A Hollweg

(57) ABSTRACT

The invention describes a method of manufacturing an electrode (1) for a gas-discharge lamp, which method comprises forming an electrode shaft (10); forming a coil (2) over a winding length (L W); arranging the coil (2) on the electrode shaft (10); and melting material of the coil (2) such that, when the melted coil material has re-solidified, the solidified material (30,31) comprises a one-piece shell (3), which one-piece shell (3) comprises a fused portion (30) over a fraction (L T) of the winding length (L W) and a mantle portion (31) over a remainder (L B) of the winding length (L W). The invention further describes an electrode (1) for a gas-discharge lamp, which electrode (1) comprises an electrode shaft (10); a coil (2) arranged on the electrode shaft (10) over a winding length (L W); and a one-piece shell (2) comprising re-solidified material of the coil (2), which one-piece shell (3) comprises a fused portion (30) over a fraction (L T) of the winding length (L W) and a mantle portion (31) over a remainder (L B) of the winding length (L W). The invention also describes a gas-discharge lamp (6) comprising a burner (4) enclosing a discharge vessel (40), a first electrode (1) and a second electrode (1), wherein the electrodes (1) are arranged to protrude into the dis-charge vessel (40) from opposite sides of the discharge vessel (40), wherein at least one of the electrodes (1) comprises an electrode (1) according to the invention.

15 Claims, 4 Drawing Sheets

(56) References Cited

U.S. PATENT DOCUMENTS

| | | | | |
|---|---|---|---|---|
| 6,492,772 | B1 | 12/2002 | Takeuchi | |
| 6,545,430 | B2 * | 4/2003 | Ono et al. | 315/291 |
| 6,593,692 | B2 * | 7/2003 | Kitahara et al. | 313/571 |
| 7,057,346 | B2 | 6/2006 | Tukamoto | |
| 7,967,449 | B2 * | 6/2011 | Onodera | 353/85 |
| 2001/0030498 | A1 * | 10/2001 | Tsutatani et al. | 313/350 |
| 2005/0007023 | A1 * | 1/2005 | Arimoto et al. | 313/642 |
| 2006/0055329 | A1 * | 3/2006 | Yamashita et al. | 313/631 |
| 2007/0132403 | A1 * | 6/2007 | Goto et al. | 315/291 |
| 2008/0203918 | A1 | 8/2008 | Onodera | |
| 2011/0037385 | A1 | 2/2011 | Nishimura et al. | |
| 2011/0163655 | A1 | 7/2011 | Stange | |

FOREIGN PATENT DOCUMENTS

| | | | |
|---|---|---|---|
| JP | 2007123150 | A | 5/2007 |
| JP | 2008004435 | A | 1/2008 |
| WO | 2009133773 | A1 | 11/2009 |
| WO | 2010025769 | A1 | 3/2010 |

* cited by examiner

A - A′

METHOD OF MANUFACTURING AN ELECTRODE FOR A GAS DISCHARGE LAMP

FIELD OF THE INVENTION

The invention describes a method of manufacturing an electrode for a gas-discharge lamp, an electrode for a gas-discharge lamp, and a gas-discharge lamp.

BACKGROUND OF THE INVENTION

The electrodes in gas-discharge lamps such as those used for digital projection lighting (DPL) become very hot during operation of the lamp. In particular, operating conditions in ultra high-pressure (UHP) gas-discharge lamps are such that temperatures of 1200 K are easily reached in the coolest area of the lamp, namely the pinch area. The temperature at the tips of the electrodes can easily reach 3700 K. At such high temperatures, the thermal load on an electrode is extreme, and the tip of the electrode can melt back and significantly alter the shape of the electrode. This is known as electrode burn-back. When both electrodes are shortened by burn-back, the separation between the front faces of the electrodes lengthens, as does the discharge arc, so that the luminance of the discharge arc is lessened.

The "light source" is the discharge arc in the case of an arc-discharge lamp, and the size and shape of the light source is directly related to the electrode separation. A small electrode separation is generally favourable since this delivers a near point-size light source with a small etendue. The etendue of the light source should match the etendue of the optical system for an optimal projector or "beamer" performance. For example, an optical panel can be based on an array of micro-mirrors on a semiconductor chip in a digital micromirror device. Since the cost of an optical panel is related to its size, the relatively large electrode separation of prior art electrodes in UHP lamps is also a cost factor in the manufacture of optical panels for projection systems using those lamps. The evolution towards smaller optical panels makes a smaller electrode separation desirable, so that the effects of burn-back exhibited by prior art electrodes can be a serious drawback.

One way of improving the thermal behaviour of an electrode that is subject to an increased thermal load would be to increase its mechanical stability, so that it would be less prone to burn-back during operation. For example, large solid electrodes could be used. However, such large electrodes are correspondingly heavy and would require a complete re-design, including adjustments to driving scheme parameters of a lamp driver.

In another known approach, a coil of tungsten wire is arranged on the electrode shaft. Usually, the coil is formed by winding wire in one or more layers around a 'dummy needle' and then transferring the completed coil onto the electrode shaft. During operation, the coil acts as a good thermal radiator and can serve to obtain a better balance between the input and output power of the electrode. However, even for such a coil-and-rod electrode, the unavoidably high temperature at the tip of the electrode will melt the electrode tip. Therefore, the shape of the prior-art coil-and-rod electrode will alter significantly so that the lamp behaviour changes during the first operating hours until a stable electrode surface is obtained. Therefore, some manufacturing methods for a coil-and-rod electrode include a step in which the altered stable operation shape of the electrode is obtained in advance, for example by melting the tip of the electrode and some of the coil to form a fused area at the front face of the electrode. A method to do this is by laser-melting the electrode tip.

The known coil-and-rod electrode designs are associated with a number of disadvantages. High power DPL lamps suffer from a specific type of electrode failure, since it may happen that parts of the coil 'open' or even break during lamp operation as a result of the high thermal load. While coil breakage occurs quickly and effectively terminates the lamp lifetime, coil opening can significantly shorten the lamp lifetime, so that both of these negative developments are highly undesirable. Furthermore, coil 'opening' means that the coil unwinds slowly under the thermal load, with a corresponding negative effect on the electrode's thermal characteristics. For example, an electrode with an 'opened' coil may be associated with an increase of lamp operating voltage, since the coil no longer fulfils its function and the electrode is subject to a greater thermal load. Also, the high thermal load in the electrode results in the very undesirable burn-back of the electrode front faces.

Therefore, it is an object of the invention to provide an improved electrode design for a gas-discharge lamp.

SUMMARY OF THE INVENTION

The object of the invention is achieved by the method according to claim 1 of manufacturing an electrode, by the electrode of claim 9, and by the gas-discharge lamp of claim 13.

According to the invention, the method of manufacturing an electrode, in particular an electrode for a UHP gas-discharge lamp, comprises the steps of forming an electrode shaft, forming a coil over a winding length, arranging the coil on the electrode shaft, and melting material of the coil such that, when the melted coil material has re-solidified, the solidified material comprises a one-piece shell or hood, preferably essentially over the entire winding length, which one-piece shell comprises a fused portion over a fraction of the winding length and a mantle portion over a remainder of the winding length.

An advantage of the method according to the invention is that the mass and thermal behaviour of the electrode thus manufactured are somewhere between the mass and thermal behaviour of a solid electrode design and a prior art coil-and-rod electrode design, so that the inventive electrode combines the advantages of these designs. The electrode thus manufactured is mechanically stronger than a prior art coil-and-rod electrode, and its coil can still behave as an efficient thermal radiator while the likelihood of coil breakage or opening is drastically reduced. Furthermore, the improved behaviour under high thermal load offered by the additional solid mass of the one-piece shell means that the electrode manufactured using the method according to the invention does not suffer from pronounced geometrical changes due to thermal load to the same extent as an electrode manufactured using a prior art technique. Therefore, using the method according to the invention, a favourably stable electrode with a prolonged lifetime can be manufactured in a particularly straightforward manner. The 'one-piece shell' is to be understood to comprise a fused portion with an uninterrupted transition to the mantle portion, even if the fused portion and mantle portion are created in separate process steps, as will be explained below. To all intents and purposes, the one-piece shell is to be regarded as a single entity. The term 'fused portion' is to be understood to mean re-solidified material of the electrode tip and the coil winding which has coalesced or combined during melting. The term 'mantle portion over a remainder of the winding length' is to be interpreted to mean that the mantle portion of the one-piece shell can extend from the fused portion to the end of the coil located towards the base of the electrode, but need not extend all the way to the end of the coil. For example, the mantle portion could terminate at a slight distance inward from the end of the coil.

According to the invention, the electrode comprises an electrode shaft, a coil arranged around the electrode shaft over a winding length, and a one-piece shell comprising re-solidified material of the coil, extending preferably essentially over the entire winding length, which one-piece shell comprises a fused portion over a first fraction of the winding length and a mantle portion over a remainder of the winding length.

Compared to a comparable prior art electrode, the inventive electrode can withstand a higher thermal load, so that it can be used for higher power applications. Also, a pair of such electrodes can be arranged closer together in a gas-discharge lamp compared to a lamp with prior art electrodes. An advantage of the electrode according to the invention is that it can be made from a standard electrode, for example by using any prior art coil-and-rod electrode as a starting point. With the one-piece shell or hood, the electrode according to the invention looks like a solid electrode and it also mechanically behaves like a solid electrode. However, since the shell is a solidification of the outside, the coil structure is maintained within the hood or in the interior of the hood, as will be explained below. The fused portion of the one-piece shell ensures that the tip of the electrode is subject to less burn-back. Therefore, the thermodynamic behaviour of the inventive electrode is somewhere in between that of a solid electrode and a prior-art coil-and-rod electrode.

According to the invention, the gas-discharge lamp—preferably a UHP gas-discharge lamp—comprises a discharge vessel, a first electrode and a second electrode arranged to protrude into the discharge vessel from opposite sides of the discharge vessel, wherein at least one of the electrodes comprises an electrode according to the invention. Such an electrode can be manufactured using the method described above.

The gas-discharge lamp according to the invention exhibits an improved behaviour compared to prior art gas-discharge lamps, since the inventive electrodes are not subject to extreme deformation, i.e. the electrodes maintain their shape better. The resulting favourably short and stable arc gives an advantageously point-like source of light essentially over the lifetime of the lamp, unlike prior art lamps, in which the luminance of the arc decreases over time as the electrode separation increases as a result of the alteration in electrode shape during burn-back. The stability of the electrodes also means that the lamp according to the invention exhibits favourable lamp voltage maintenance over its lifetime.

The dependent claims and the following description disclose particularly advantageous embodiments and features of the invention. Features of the embodiments may be combined as appropriate. Features described in the context of one claim category can apply equally to another claim category.

Since the one-piece hood comprises distinct regions, namely the fused region and the mantle region, in a preferred embodiment of the method according to the invention the step of melting material of the coil comprises a first melting step to shape a first coil region and a second melting step to shape a second coil region, so that the first and second coil regions can be shaped differently and independently of each other.

Preferably, the first coil region comprises a portion of the coil arranged around a tip of the electrode, and the first melting step comprises melting material of the first coil region and material of the electrode tip such that the melted material of the coil in the first coil region coalesces or combines with the melted material of the electrode tip to give the fused portion of the one-piece shell. This fused portion allows the electrode tip to behave in a very favourable manner during operation, since a melting back of the electrode is largely prevented, thus effectively allowing the electrode to maintain its shape over the lifetime of the lamp, without any severe geometrical distortion.

Since the one-piece shell comprises a mantle region as well as the fused region, in a preferred embodiment of the invention the second coil region comprises at least part of the remainder of the coil adjacent to the fused portion, and the second melting step comprises melting material of the second coil region to give the mantle portion of the one-piece shell. Here, the "remainder of the coil adjacent to the fused portion" is to be understood to mean that the second coil region comprises the remainder of the coil winding behind the fused portion, which is located at the tip of the electrode, as described above, and that this second coil region can extend all the way up to the end of the winding, but can equally well terminate at a distance inward from the end of the winding.

Preferably, the one-piece shell is formed symmetrically around the entire circumference of the coil over essentially the entire winding length, so that the hood or shell appears essentially the same when viewed from any side of the electrode. Of course, if certain thermal properties are desired, the mantle could be formed in an uneven or asymmetrical manner, for example with a mantle extending to the end of the coil winding on an upper side of the electrode, and not quite extending to the end of the coil winding on a lower side of the electrode.

Any suitable technique of applying heat to melt the coil and electrode material could be used to shape the one-piece shell. However, in a particularly preferred embodiment of the invention, the step of melting material of the coil comprises directing a beam of laser light at the coil. In this way, energy can be deposited very precisely, to precisely chosen depths in the material of the coil and/or electrode, in order to melt only desired regions of the coil and/or electrode.

Since the fused portion of the one-piece hood comprises re-solidified material of the electrode tip and the coil winding, while the mantle portion comprises only re-solidified material of an outer layer of the coil winding, in a preferred embodiment of the invention, a first beam of laser light generated using a first set of laser parameters is directed at the first coil region in the first melting step to form the fused portion of the one-piece shell, while a second beam of laser light generated using a second set of laser parameters is directed at the second coil region in the second melting step to form the mantle portion of the one-piece shell. In this way, the different material thicknesses and macroscopic thermal properties can be taken into consideration, and the appropriate amounts of energy can be deposited at the appropriate locations.

As mentioned above, the coil serves to radiate heat away from the body of the electrode during operation of the lamp to improve the balance between the input and output power of the electrode. The number of winding layers of the coil can influence the thermal properties of the finished electrode. Therefore, the step of forming a coil comprises wrapping a wire around a dummy needle to form an inner coil layer and subsequently wrapping a wire around the inner coil layer to form another outer coil layer. The coil can be wound in any suitable manner. For example, it may be favourable to start at the tip of the electrode and wind an inner layer to a certain point on the dummy needle, and then to reverse the winding direction to wind an additional outer layer, which may or may not extend over the entire winding length. The same wire can be used for inner and outer winding layers, or different wires may be used, as appropriate. The completed winding can then be transferred from the dummy needle to the electrode shaft prior to the melting steps. The orientation of the winding mounted on the electrode shaft can be such that a single winding layer is arranged close to the electrode front face, while a double or even triple winding layer is arranged further down the electrode shaft, or vice versa. The chosen orientation will depend on other factors, as will be understood by the skilled person. Preferably, the outer winding layer terminates a certain distance 'behind' or further back from the front face of the electrode, so that when the material of the coil and the material of the electrode tip are melted to fuse together, a favourably 'pointed' shape can be formed in the front region of the one-piece shell or hood.

In the fused portion of the one-piece shell, the coil winding structure is no longer present, so that energy can only be radiated away from the electrode from the outer surface of the shell. Therefore, in a particularly preferred embodiment of the invention, the coil winding comprises an inner coil layer and at least one outer coil layer, and the mantle portion of the one-piece shell comprises a re-solidified outer coil layer. In this way, an inner coil layer underneath the mantle can still act to draw heat away from the electrode body and therefore also from the tip of the electrode, while the outer mantle ensures an improved mechanical performance under thermal load. Of course, the coil winding can comprises two, three or even more inner coil layers.

The thermal radiation of the coil can depend to some extent of the dimensions of the coil. Therefore, in a further preferred embodiment of the invention, the coil comprises tungsten wire. Preferably, the wire has a cross-sectional diameter in the range 0.1 mm to 0.5 mm.

The behaviour of the electrode under thermal load will depend to a large extent on the mass of the electrode. An evenly distributed mass along the body of the electrode can ensure an even or homogenous heat convection along the electrode shaft. Therefore, in a further preferred embodiment of the invention, the electrode shaft comprises an essentially rod-shaped shaft of high-purity tungsten. Preferably, the shaft has a diameter in the range 0.2 mm to 1.2 mm.

The luminous flux and the luminance of a discharge arc established between the front faces of two opposing electrodes will depend on the distance between the front faces. Therefore, in a particularly preferred embodiment of the invention, a separation between a front face of the first electrode and a front face of the second electrode can be in a range between 0.7 mm and 1.6 mm, depending on the optical characteristics of the lighting assembly or lighting system in which the lamp is to be used. Generally, in a gas-discharge lamp according to the invention, the electrodes can be positioned closer to each other, for example with an electrode separation of about 80% of the electrode separation in a comparable prior art lamp, so that a shorter arc with a correspondingly higher luminance can be established. The collection efficiency of the gas-discharge lamp according to the invention, i.e. the ratio of luminous flux collected through an aperture to the total luminous flux of the lamp can be favourably increased in the region of about 10 percent compared to a gas-discharge lamp with prior art electrodes.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
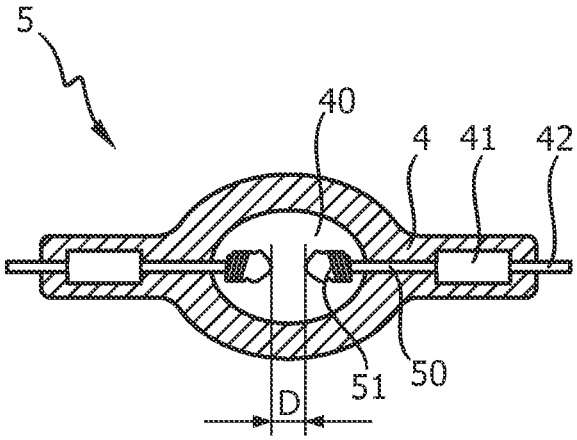
(prior art) FIG. 1
FIG. 1 shows a prior art UHP lamp with prior art electrodes.
Figure 2:
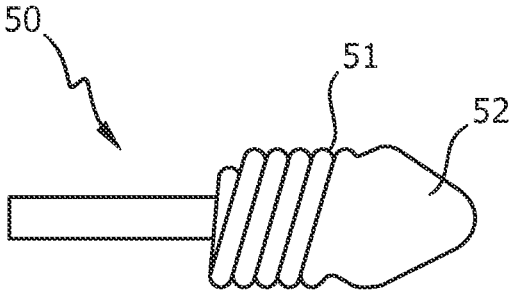
(prior art) FIG. 2
FIG. 2 shows a prior art electrode.

FIG. 1 shows a prior art UHP lamp 5, comprising a quartz glass burner 4 enclosing a discharge chamber 40. A pair of electrodes 50 is disposed in a co-linear arrangement in the discharge chamber 40 such that the front faces of the electrodes 50 are separated by a distance D. Each electrode 50 is connected to a molybdenum foil 41 in a pinch region of the lamp 5, and this foil 41 is in turn connected to an external electrode lead 42, so that a voltage can be applied across the electrodes 50. Each electrode 50 comprises a coil winding 51, which is partially melted in a fused region 52 at the tip of the electrode 50 to combine with the material of the electrode 50. This prior art electrode design is shown in FIG. 2 in more detail. The fused region 52 of the electrode 50 protects the electrode tip region from serious deformation during operation of the lamp 5.

Figure 3:
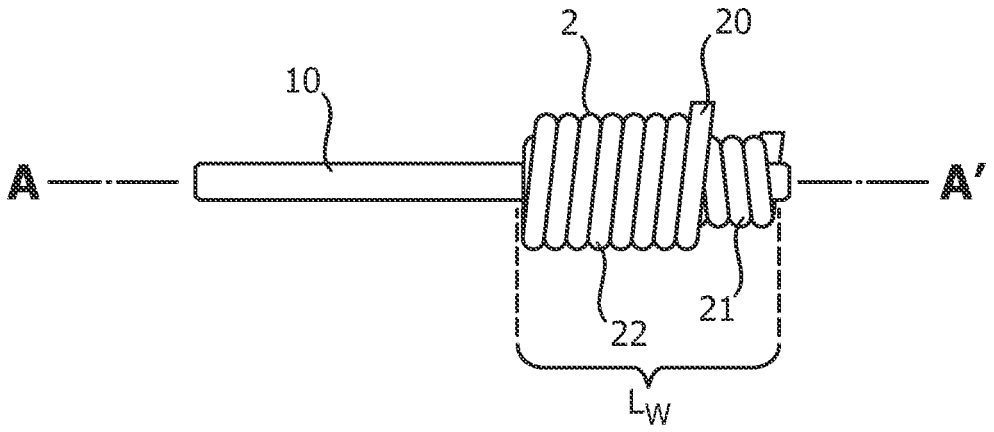
FIG. 3 shows an electrode component prior to melting.
Figure 4:
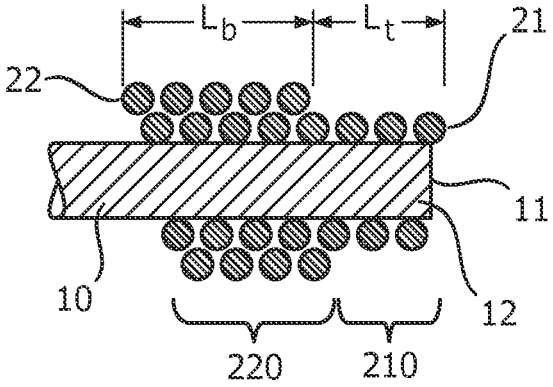
FIG. 4 shows a cross-section of an electrode prior to melting.

FIG. 3 shows an electrode component prior to melting, and shows an electrode shaft 10 and a winding 2, made by arranging a previously wound coil on the electrode shaft. The coil can have been made separately in a previous step by wrapping a tungsten wire in one or more coil layers—an inner coil layer 21 and an outer coil layer 22 are shown in this example—around a dummy needle (not shown) over a winding length $L_W$. The coil is then transferred onto the electrode shaft 10, as shown here. In this example, the coil is arranged on the electrode shaft 10 so that the outer coil layer 22 terminates at a distance from the front face 11 of the electrode. Of course, the coil 2 could be mounted the other way around, depending on the performance requirements of the electrode. The winding 2 shown here effectively gives two distinct coil regions 210, 220, namely a first coil region 210 close to the electrode front face 11 and wound about a tip region 12 of the shaft 10 over a first fraction $L_T$ of the winding length $L_W$, and a second coil region 220 over the remaining fraction $L_B$ of the winding length $L_W$. FIG. 4 shows a cross-section of this component prior to melting. As can be seen in the diagram, a first fraction or length $L_T$ of the winding comprises a single inner coil layer 21 in this example, while a second fraction or length $L_B$ of the winding comprises two coil layers 21, 22. Of course, the first fraction $L_T$ of the winding could also extend to include some part of the outer coil layer 22. In another example, the first fraction $L_T$ of the winding might comprise only a part of the exposed inner coil layer 21, while the second fraction or length $L_B$ of the winding might comprise the winding over most or all of the outer coil layer 22 as well as some of the exposed inner coil layer 21.

Figure 5:
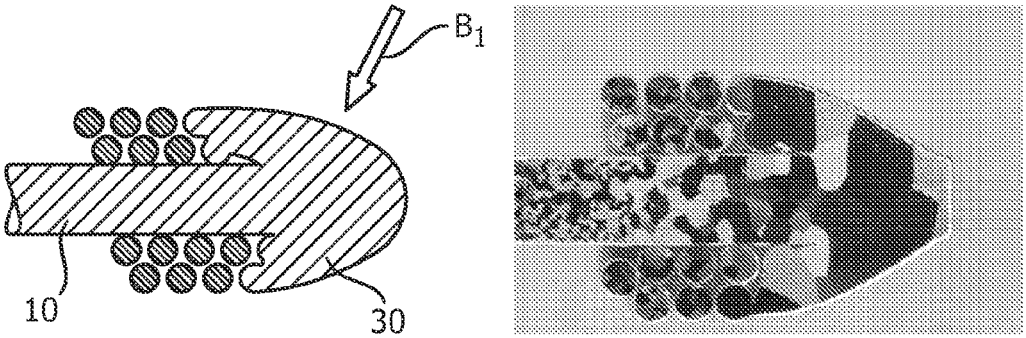
FIG. 5 shows a cross-section of an electrode according to the invention after a first melting step and a corresponding image of a cross-section through a real electrode.

FIG. 5 shows a cross-section of the component of FIG. 4 after a first melting step and a corresponding first image of a cross-section through a real electrode after the first melting step. Here, the material of the shaft 10 has been melted along with the inner coil layer 21 of the first length $L_T$ of the winding, by directing a suitable beam $B_1$ of laser light at the first coil region 210 to deposit energy in the material of the coil 21 in that first coil region 210 and in the body of the electrode tip region 12 so that the melted material of these regions 210, 12 coalesces or combines to give a fused region 30 with a front face 11. Depending on the laser parameters applied during the laser melt step, a part of the second coil 22 close to the first coil region 210 could also be melted. After re-solidification, this fused solid region 30 provides the electrode with favourable thermal properties, ensuring that it essentially maintains its shape during operation and does not melt back significantly even under extremely high temperatures. As the first image shows, the material of the electrode tip has coalesced or fused with the material of the inner coil and some of the outer coil.

Figure 6:
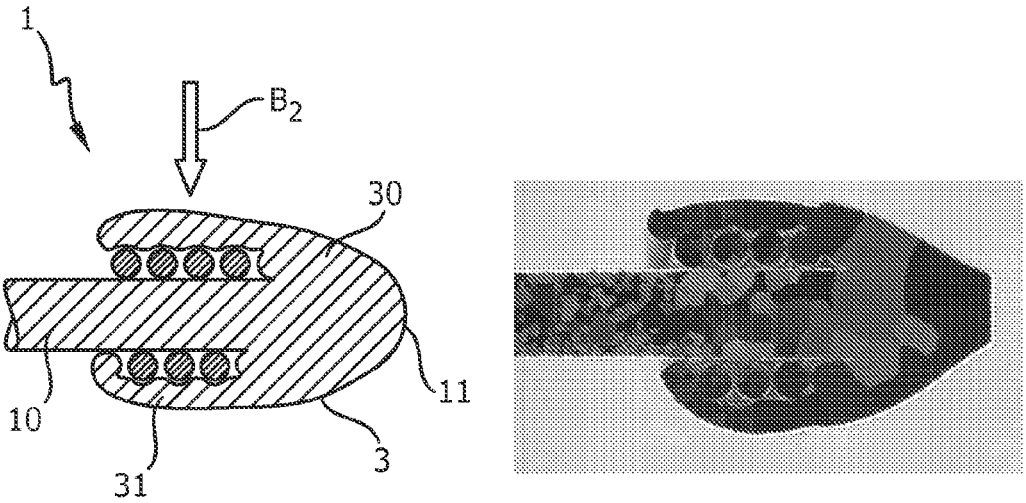
FIG. 6 shows a cross-section of an electrode according to the invention after a second melting step and a corresponding image of a cross-section through a real electrode.

FIG. 6 shows a cross-section of an electrode 1 according to the invention after a second melting step and a corresponding second image of a cross-section through a real electrode after the second melting step. Here, the material of the outer coil layer 22 has been melted to give a mantle region 31 by directing a suitable beam $B_2$ of laser light at the second coil region 220 to deposit energy in the material of the outer coil winding 22 in that second coil region 220. After re-solidification, the mantle 31 is joined essentially without interruption to the fused region 30. In this way, a one-piece hood 3 or shell 3 is obtained. Below the mantle 31, the coil structure of the inner winding layer 21 is preserved, so that the electrode body comprising the inner coil layer 21 and the mantle portion 31 can still function satisfactorily as a thermal radiator. Any heat transported from the inner coil layer 21 to the mantle 31 is efficiently dissipated, so that the electrode's power scheme can be held in balance during operation, even at very high temperatures.

In the melting steps described above, process parameters in generating the laser beams $B_1$, $B_2$ can comprise appropriate choice of pulse time, pulse power, optical path, the number of pulses in a pulse sequence, pulse frequency, etc. Also, the electrode shaft can be rotated while the laser beam $B_1$, $B_2$ is being aimed at the coil region being melted, and parameters such as the speed of rotation and number of revolutions can be chosen accordingly. Other parameters such as ambient gas, gas flow, position of the laser with respect to the electrode, thermal contact of the electrode with a holding arrangement, the time between the first melting step and the second melting step etc., can be chosen and adjusted to give the desired results.

Figure 7:
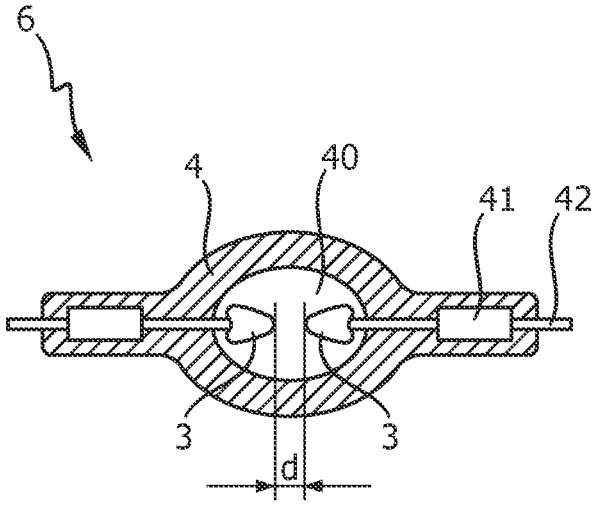
FIG. 7 shows a UHP lamp according to the invention.

FIG. 7 shows a UHP lamp 6 according to the invention, with essentially the same structure as the lamp 5 shown in FIG. 1. Here, two electrodes that have been manufactured using the inventive method to each comprise a one-piece shell 3, are disposed essentially co-linearly in the discharge chamber 40 of the burner 4. Since the one-piece shell 3 of each electrode 1 manufactured using the method described above ensures a very favourable thermal behaviour, without any significant growth of spikes or projections even at prolonged temperatures in the region of 3600° C., the electrodes 1 can be placed closer together. In the example shown, the lamp 6 comprises a UHP lamp with a discharge chamber 40 having a capacity of about 116 μl. The electrodes are separated by a short distance of as little as 0.7 mm, up to about 1.6 mm, allowing a very short and bright discharge-arc to be established.

Although the present invention has been disclosed in the form of preferred embodiments and variations thereon, it will be understood that numerous additional modifications and variations could be made thereto without departing from the scope of the invention. For example, it is conceivable that the electrode according to the invention could be used in newer developments in the field of MSR (medium source rare-earth) lamps for theatre lighting.

For the sake of clarity, it is to be understood that the use of "a" or "an" throughout this application does not exclude a plurality, and "comprising" does not exclude other steps or elements.

The invention claimed is:

1. A method of manufacturing an electrode for a gas-discharge lamp, which method comprises forming an electrode shaft;

forming a coil over a winding length ($L_W$), wherein the winding length consists of a fraction ($L_T$) of the winding length ($L_W$) and a remainder ($L_B$) of the winding length (Lw);

arranging the coil on the electrode shaft;

melting material of the coil such that, when the melted coil material has re-solidified, the solidified material comprises a one-piece shell, which one-piece shell comprises a fused portion over the fraction ($L_T$) of the winding length ($L_W$) and a mantle portion over the entire length of the remainder ($L_B$) of the winding length ($L_W$), wherein the fused portion comprises re-solidified material of an electrode tip and the coil winding which has coalesced during melting.

2. A method according to claim 1, wherein the step of melting material of the coil comprises a first melting step to shape a first coil region and a second melting step to shape a second coil region.

3. A method according to claim 2, wherein the first coil region comprises a portion of the coil arranged around a tip of the electrode shaft, and the first melting step comprises melting material of the first coil region and material of the electrode tip such that the melted material of the coil in the first coil region coalesces with the melted material of the electrode tip to give the fused portion of the one-piece shell.

4. A method according to claim 2, wherein the first coil region gives the fused portion, and the second coil region comprises part of the remainder of the coil adjacent to the fused portion, and the second melting step comprises melting material of the second coil region to give the mantle portion of the one-piece shell.

5. A method according to claim 1, wherein the one-piece shell is formed around the entire circumference of the coil over essentially the entire winding length.

6. A method according to claim 1, wherein the step of melting material of the coil comprises directing a beam of laser light at a region of the coil.

7. A method according to claim 6, wherein a first beam of laser light generated using a first set of laser parameters is directed at the first coil region in the first melting step to form the fused portion of the one-piece shell, and a second beam of laser light generated using a second set of laser parameters is directed at the second coil region in the second melting step to form the mantle portion of the one-piece shell.

8. A method according to claim 1, wherein the step of winding a coil around the electrode shaft over a winding length comprises wrapping a wire around the electrode shaft to form an inner coil layer and subsequently wrapping a wire around the inner coil layer to form an outer coil layer.

9. An electrode for a gas-discharge lamp, which electrode comprises an electrode shaft;

a coil arranged on the electrode shaft over a winding length, wherein the winding length consists of a fraction of the winding length and a remainder of the winding length; and a one-piece shell comprising re-solidified material of the coil, which one-piece shell comprises a fused portion over said fraction of the winding length and a mantle portion over the entire length of said remainder of the winding length, wherein the fused portion comprises re-solidified material of an electrode tip and a portion of the coil winding located in said fraction of the winding length which has coalesced during melting.

10. An electrode according to claim 9, comprising an inner coil layer and at least one outer coil layer, and wherein the mantle portion of the one-piece shell comprises a re-solidified outer coil layer.

11. An electrode according to claim 9, wherein the electrode shaft is essentially rod-shaped with a diameter in the range 0.2 mm to 1.2 mm.

12. An electrode according to claim 9, wherein the one-piece shell extends essentially over the entire winding length.

13. A gas-discharge lamp comprising a burner enclosing a discharge vessel, a first electrode and a second electrode, wherein the electrodes are arranged to protrude into the discharge vessel from opposite sides of the discharge vessel, wherein at least one of the electrodes comprises an electrode according to claim 9.

14. A gas-discharge lamp according to claim 13, wherein the lamp comprises an ultra high pressure gas discharge lamp.

15. A gas-discharge lamp according to claim 13, wherein a separation (d) exists between a front face of the first electrode and a front face of the second electrode wherein said separation is in the range of 0.7 mm to 1.6 mm.

* * * * *